United States Patent [19]

Asano

[11] 4,241,122

[45] Dec. 23, 1980

[54] ARTIFICIAL LEATHER HAVING CHINCHILLA-LIKE APPEARANCE AND NATURAL SUEDE-LIKE FEELING AND A METHOD FOR PRODUCING THE SAME

[75] Inventor: Koin Asano, Takatsuki, Japan

[73] Assignee: Kanebo, Ltd., Tokyo, Japan

[21] Appl. No.: 88,996

[22] Filed: Oct. 29, 1979

[30] Foreign Application Priority Data

Oct. 31, 1978 [JP] Japan ..... 53-135075

[51] Int. Cl.[3] ..... B32B 33/00; B05D 1/14; B05D 1/16

[52] U.S. Cl. ..... 428/90; 428/91; 428/373; 428/374; 428/904; 427/26; 427/200; 427/206

[58] Field of Search ..... 428/90–97, 428/373, 374, 904; 427/26, 200, 206

[56] References Cited

U.S. PATENT DOCUMENTS

| | | | |
|---|---|---|---|
| 3,865,678 | 2/1975 | Okamoto et al. | 428/91 |
| 3,968,284 | 7/1976 | George | 428/90 |
| 4,073,988 | 2/1978 | Nishida et al. | 428/91 |

*Primary Examiner*—William J. Van Balen

*Attorney, Agent, or Firm*—Blanchard, Flynn, Thiel, Boutell & Tanis

[57] ABSTRACT

An artificial leather having chinchilla-like appearance and a natural suede-like feeling which comprising flocking piles of separable composite fibers which in transverse cross-section consist of at least three integral segments (A) of one polymer of polyamide and polyester wherein said segments diverge from each other substantially radially in the outward direction and extend to the perimeter of the fiber and wedge-shaped segments (B) of another polymer which fill the spaces between the segments (A) or consist of the above described segments (A), V-shaped segments (B′) of the latter polymer and wedge-shaped segments (C) of the former polymer which fill the concavities of the V-shaped segments (B′), said V-shaped segments (B′) and said wedge-shaped segments (C) filling the spaces between the segments (A), wherein all of the polymers extend to the perimeter of the fiber, on a substrate fabric applied with an adhesive, applying a swelling agent on the piles, brushing the thus treated piles to substantially separate each segment in the above described cross-section and then subjecting the brushed piles to a wet heat treatment.

33 Claims, 19 Drawing Figures

X200

ARTIFICIAL LEATHER HAVING CHINCHILLA-LIKE APPEARANCE AND NATURAL SUEDE-LIKE FEELING AND A METHOD FOR PRODUCING THE SAME

The present invention relates to an artificial leather having chinchilla-like appearance and a natural suede-like touch and a method for producing the same, more particularly to a novel artificial leather having chinchilla-like beautiful appearance, a natural suede-like soft touch (feeling) and a stable and good chalk mark property and a method for commercially advantageously producing the same.

So called "flocked cloth" in which piles are flocked on a substrate fabric by, for example, electrostatic flocking process, is relatively similar to natural leather in density and appearance but the flocked cloth has no chalk mark property (suede effect), so that said cloth is flat and has no three dimensional feeling and shows a woven fabric-like feeling.

In order to obviate these drawbacks, it has been heretofore attempted that the flocked cloth is particularly pressed or irregular or uneven shrinkage is given to a substrate fabric for electrostatic flocking or even if an even shrinkage is given, difference of shrinkage is provided in the thickness direction so as to cause natural leather-like creases, whereby the chalk mark feeling is obtained. However, the flocked cloth obtained by these processes has no pile structure having the inherent chalk mark property and further the three dimensional feeling due to the unevenness of length of piles cannot be obtained.

As methods for producing flocked cloths wherein piles composed of superfine fibers project, the following methods have been known. That is, in the first method (Japanese Patent Laid-open Application No. 14,462/72), piles composed of mix-spun fibers having islands-in-a-sea structure consisting of two or more synthetic high molecular weight compounds having different solubility are flocked and then the sea constituent or the island constituent in the islands-in-a-sea structure of pile is dissolved and removed with a solvent and in the second method (British Pat. No. 130,028), after the dissolving and removing step in the above described method, drying and brushing steps are conducted.

However, in any one of the above described methods the satisfactory chalk mark property cannot be obtained and the durability of the flocks is poor. The piles of the island constituent remaining after the sea constituent (B in FIG. 1) is dissolved and removed, are very fine (about less than 0.005 denier) and the adhering area of the roots of the piles is very small, so that when the piles are rubbed, they are readily separated. Furthermore, the rotus root-shaped piles composed of the sea constituent after dissolution of the island constituent cannot improve the chalk mark property and the feeling even if brushing is carried out. Even if a flocked cloth or an artificial leather having a certain degree of suede-like appearance can be produced by the above described known technics, it has been impossible to obtain artificial leather having chinchilla-like appearance.

An object of the present invention is to provide an artificial leather having chinchilla-like excellent appearance, natural suede-like soft feeling, good chalk mark property (suede effect), and higher mechanical property and durability than natural suede and a novel method for producing the same.

Another object of the present invention is to provide an artificial leather having chinchilla-like appearance and natural suede-like feeling in which the piles of the surface show superfine fibril form, the density of the fibrillated piles is high, the density of polyamide fibrils increases from the surface of the pile layer toward the substrate fabric and each fibril is irregularly curved and the fibrils are entangled.

The term "chalk marks property" used herein means the unique appearance effect of the natural suede that when the fibrillated pile surface is touched with a finger, the fibrillated piles uniformly lay in a constant direction and as a result the reflection direction of light varies and the touched trace remains on the surface and is visible.

The term "chinchilla-like appearance" used herein means the appearance that the color tone (deepness and lightness of light) of the fibrillated pile layer partially is different depending upon the irregular direction property (disturbance of fibrillated pile arrangement) of the fibrillated piles and said difference forms irregular patterns to form the surface pattern of chinchilla fur.

The first aspect of the present invention consists in an artificial leather having a suede-like touch and chinchilla-like appearance consisting of a substrate fabric and curved and entangled fibrillated piles stuck on the substrate fabric with an adhesive, said fibrillated piles consisting of polyamide and polyester and having been obtained by fibrillating the piles composed of separable composite fibers which in transverse cross-section consist of at least three integral segments (A) of one polymer of the above described two polymers wherein said segments diverge from each other substantially radially in the outward direction and extend to the perimeter of the fiber and wedge-shaped segments (B) of another polymer which fill the spaces between the segments (A) or consist of the above described segments (A), V-shaped segments (B') of the latter polymer and wedge-shaped segments (C) of the former polymer which fill the concavities of the V-shaped segments (B'), said V-shaped segments (B') and said wedge-shaped segments (C) filling the spaces between the segments (A), wherein all of the polymers extend to the perimeter of the fiber, so that the polymers are separated from each other to form very fine curved fibrils of (A) and (B) or (A), (B') and (C), which form fibrillated pile layer in which a content ratio by weight of polyamide fibrils in said pile layer increases from the surface of the pile layer toward the substrate fabric surface and the content ratio by weight of polyamide fibrils in total fibrils in an upper layer of $\frac{1}{3}$ of the total thickness of said pile layer from the surface of said layer is not more than 80% of a content ratio by weight of polyamide fibrils in the total fibrils in a lower layer of $\frac{2}{3}$ of the total thickness of said pile layer from the root portion of the fibrillated piles.

The second aspect of the present invention consists in a method for producing an artificial leather having chinchilla-like appearance and a natural suede-like feeling which comprising flocking piles of separable composite fibers which in transverse cross-section consist of at least three integral segments (A) of one polymer of polyamide and polyester, wherein said segments diverge from each other substantially radially in the outward direction and extend to the perimeter of the fiber and wedge-shaped segments (B) of another polymer which fill the spaces between the segments (A) or consist of the above described segments (A), V-shaped segments (B') of the latter polymer and wedge-shaped segments (C) of the former polymer which fill the concavities of the V-shaped segments (B'), said V-shaped segments (B') and said wedge-shaped segments (C) filling the spaces between the segments (A), wherein all of the polymers extend to the perimeter of the fiber, on a substrate fabric applied with an adhesive, applying a swelling agent on the piles, brushing the thus treated piles to substantially separate each segment in the above described cross-section and then subjecting the brushed piles to a wet heat treatment.

The term "separable composite fibers which in transverse cross-section consist of at least three integral segments (A) of one polymer of polyamide and polyester wherein said segments diverge from each other substantially radially in the outward direction and extend to the perimeter of the fiber and wedge-shaped segments (B) of another polymer which fill the spaces between the segments (A)" used herein has the cross-sectional shapes as shown in FIGS. 3–6 and can be separated into the segments (A) and (B) as shown in FIGS. 10–13.

The term "segments (A) which diverge from each other substantially radially in the outward direction and extend to the perimeter of the fiber" used herein means the segments having the cross-sectional shapes of +-shape as shown in FIGS. 4 and 8 and (A) in FIGS. 11 and 15, Y-shape as shown in FIGS. 3 and 7, and (A) in FIGS. 10 and 14, and of radial shapes (* , *) as shown in FIGS. 5, 6 and 9 and (A) in FIGS. 12, 13 and 16.

The term "wedge-shaped segment (B) and V-shaped segment (B')" used herein means the segments as shown in FIGS. 3, 4, 5 and 6, and (B) in FIGS. 10–13.

In addition, the present invention can use the separable composite fibers consisting of the above described segments (A), V-shaped segments (B') and wedge-shaped segments (C) which fill the concavities of the V-shaped segments (B'), said V-shaped segments (B') and said wedge-shaped segments (C) filling the spaces between the segments (A). These composite fibers are shown in FIGS. 7–9 and can be separated into the segments as shown in (A), (B') and (C) in FIGS. 14–16.

The above described segments (A) means ones which diverge from each other substantially radially in the outward direction and extend to the perimeters of the fiber.

The V-shaped segments (B') are ones as shown in FIGS. 7–9 and (B') in FIGS. 14–16.

The wedge-shaped segments (C) are ones as shown in FIGS. 7–9 and (C) in FIGS. 14–16.

The above described segments mean the portions constituting the cross-sections of the composite filaments and consist of the polyamide and polyester which have low adhesive affinity and the segments (A) and (C) are the same polymer, and may be either polyamide or polyester and the segments (B) and (B') are another polymer, that is, for example, when the segments (A) and (C) are polyamide, the segments (B) and (B') are polyester. The above described shape of segments is "substantially" but the term "substantially" is omitted for convenience.

The composite fiber is referred to as "conjugate fiber".

The composite fibers used in the present invention are conveniently referred to as "separable composite fibers" in view of the property that the linear polyamide polymers and the linear polyester polymers which are low (readily separate) in the mutual adhering force, are bonded with each other as mentioned above to form the cross-section but the formed fibers are readily disengaged (separated, fibrillated) into each segment by being subjected to chemical or mechanical stimulation in the steps of brushing treatment after applying a swelling agent or a subsequent wet heat treatment mentioned hereinafter.

The separable composite fibers having the cross-sectional shapes as shown in FIGS. 3, 4, 5, 6, 7, 8 and 9 are separated into the segments as shown in FIGS. 10, 11, 12, 13, 14,15 and 16 respectively.

As the separable composite fibers of the present invention, the composite fibers having the cross-sections as shown in FIGS. 3–9 are preferable. Because, these composite fibers having such cross-sections are easy in the production and are not readily separated and are stable only by cutting and impact upon production of piles or applying a swelling agent and are readily separated (fibrillated) by brushing and wet heat treatment) to form a large number of superfine fibrils.

Among them, the composite fibers having the cross-sections as shown in FIGS. 4, 5, 6 and 8 provide the articles having more soft touch, better appearance and higher chalk mark property and these composite fibers are particularly preferable.

Even if the islands-in-a-sea type composite fibers as shown in FIG. 1, which are shown as a comparison, are subjected to the fibrillating treatment similarly to the present invention, it is impossible to provide the chalk mark property. Furthermore, even if the specific sea constituent or island constituent is dissolved and removed, it is difficult to obtain the articles having high durability of piles or chinchilla-like appearance.

In the side-by-side type composite fiber having a hollow portion as shown in FIG. 2, which is shown as a comparison, since the center portion is hollow and the segment (A) and the segment (B) are supported only by the adhesive force (contact) of both the sides, the fiber is separated into each segment by the force when forming piles to form superfine fibrils, so that such a fiber is not preferable. The superfine fibers are difficult in uniform flocking.

The separable composite fibers according to the present invention can be produced by melting a linear polyamide and a linear polyester and conjugate spinning the melts by well known processes. As the linear polyamides, mention may be made of, for example, nylon 4, nylon 6, nylon 7, nylon 11, nylon 12, nylon 66, nylon 610, polymetaxylylene adipamide, polyparaxylylene adipamide, polybiscyclohexylmethane dodecamide or copolyamides wherein these polyamides are the component. As the linear polyesters, mention may be made of, for example, polyethylene terephthalate, polytetramethylene terephthalate, polyethyleneoxybenzoate, poly-1,4-dimethylcyclohexane terephthalate, polypivalolactone and the like.

The fineness of the monofilament of the separable composite fibers according to the present invention is 1.0–3.0 deniers, preferably 1.2–2.5 deniers. When the fineness of the monofilament is too small, the adhesive force of the adhesive to piles and the friction resistance of the superfine fibrils decrease, while when the fineness is too large, it is difficult to form superfine fibrils mentioned hereinafter and the chalk mark property becomes poor.

The conjugate ratio by weight of the linear polyamide to the linear polyester in the composite fibers is 1:5–5:1, preferably 1:3–3:1, more preferably 1:2.5–2.5:1.

As substrate fabrics in the present invention, mention may be made of non-woven fabrics, woven fabrics, knitted goods composed of at least one of cotton, viscose rayon, cellulosic acetate fibers, polyester fibers and polyamide fibers.

The adhesive stuck on the substrate fabric of the product of the present invention is a solid (cured product in a thermosetting adhesive) of the adhesives mentioned hereinafter and forms a thin layer, by which the piles of separable composite fibers are steadly adhered on the substrate fabric. The amount of cured adhesive is 78–185 g, preferably 88–155 g per 1 $m^2$ of the substrate fabric. When the amount of the adhesive is too small, it is difficult to secure piles stably and when the amount is too large, the feeling of the product is deteriorated.

The piles of the separable composite fibers in the product (artificial leather) of the present invention are secured by the adhesive layer and constitute the portion from the top of the root of the piles in the adhesive layer to the root portion of the piles on the adhesive layer. The depth of the piles embedded in the adhesive layer is about 0.02–0.07 mm and very short and the piles in such a portion cannot be visible by naked eyes.

The density of the piles of the separable composite fibers is 15,000–150,000 piles, preferably 27,000–120,000 piles per 1 $cm^2$ of the substrate fabric. When the pile density is too small, the density of the superfine fibrillated piles of the product is too low and the chalk mark property and the appearance are poor, while when the pile density is too large, the density of the superfine fibrillated piles of the product is too high and the chalk mark property of the product is apt to become poor.

"Pile portion" in the product of the present invention where is formed from the root portion of the piles to the upper surface in FIG. 17, is constructed with a large number of superfine fibrils (polyamide fibrils and polyester fibrils) formed by fibrillation of the respective segments in the cross-section of the above described composite fibers.

This portion is conveniently referred to as "pile portion" herein. The pile density of the superfine fibrils forming this pile layer is 250,000–600,000 fibrils per 1 $cm^2$ of the substrate fabric, preferably 300,000–500,000 fibrils. When this pile density is too low, the appearance of the product is poor, while when said density is too high, the chalk mark property becomes poor.

The thickness (l in FIG. 17) of the pile layer is usually 0.2–1.5 mm, preferably 0.3–1.2 mm.

The length of the polyamide fibrils forming the pile layer is usually 0.23–1.6 mm, preferably 0.36–1.35 mm and is fairly shorter than the length of the polyester fibrils. When the length of the polyamide fibrils is too long or is longer than the length of the polyester fibrils, the appearance, the abrasion resistance and the chalk mark property of the product are liable to become poor. When said length is too short, the chalk mark property and the appearance may be deteriorated. The cross-sectional shape of the polyamide fibrils is preferred to be the above described radial shape, because the radial shape provides the particularly desirable appearance and chalk mark property.

The length of the polyester fibrils is usually 0.28–2.0 mm, preferably 0.45–1.65 mm and is fairly longer than that of the polyamide fibrils. If the length of the polyester fibrils is too short or too longer, the appearance and the chalk mark property are liable to be deteriorated.

The fineness of the superfine fibrils (polyamide fibrils and polyester fibrils) is usually 0.05–0.8 denier, preferably 0.05–0.6 denier, more particularly 0.1–0.5 denier. When the fineness is too small, the abrasion resistant fastness of the piles is deteriorated and when the fineness is too large, the touch (feeling) becomes poor.

The weight ratio of the polyamide fibrils to the polyester fibrils in the pile layer is 1:5–5:1, preferably 1:3–3:1. If the amount of the polyamide is too small, the appearance is liable to become poor and if the amount is too large, the appearance and the abrasion resistant fastness are liable to become poor.

The most necessary requirement for the product of the present invention consists in that fibrils are curved or bent and are substantially entangled in such a state that a content ratio by weight of polyamide fibrils in the pile layer increases from the surface of the pile layer toward the substrate fabric surface and the content ratio by weight of polyamide fibrils in total fibrils in an upper layer of $\frac{1}{3}$ of the total thickness (l in FIG. 17) of said pile layer from the surface of said layer is not more than 80% preferably not more than 70%, most preferably 70–30% of a content ratio by weight of polyamide fibrils in the total fibrils in a lower layer of $\frac{2}{3}$ of the total thickness of said pile layer from the root portion of the fibrillated piles.

If this requirement is not satisfied, the chinchilla-like appearance, the natural suede-like feeling, the good chalk mark property and the high abrasion resistant fastness cannot be developed. This fact will become apparent from the result of Examples and Comparative Examples described hereinafter.

Chinchilla-like appearance and the natural suede-like good chalk mark property in the product of the present invention can be developed by the facts that the relative content of the polyamide fibrils in the pile layer is not more than 80% and that the superfine fibrils are irregularly curved or bent and are entangled.

Since the superfine fibrils are irregularly curved and entangled and the superfine fibrils of the pile layer surface are constructed mainly with polyester fibrils, the abrasion resistant fastness (strength of flocked fibrils and abrasion resistance by Sheaffer test explained hereinafter) are very high.

The polyamide fibrils and the polyester fibrils forming the pile layer are superfine and the pile layer surface is formed mainly with polyester fibrils, so that the product gives the very soft feeling and the good touch.

The product of the present invention is a novel artificial leather having chinchilla-like elegant and noble appearance and the suede-like good chalk mark property and the soft touch and the higher mechanical strength (abrasion resistant fastness) than the natural suede and is very high in the commercial value. The product of the present invention has very useful applications for clothes, shoes, bags, interior articles and the like.

Then a further explanation will be made hereinafter with respect to the second aspect of the present invention, that is a method for producing the artificial leather having chinchilla-like appearance and natural suede-like feeling.

The separable composite fibers as mentioned above are cut into an appropriate length to form piles for blocking and the formed piles are flocked on a substrate fabric but the composite fibers have the stable structure, so that the composite fibers are not separated (disengaged) into each segment upon cutting and flocking.

The length of the piles composed of the separable composite filaments is usually 0.3–2.0 mm, preferably 0.5–1.7 mm.

When the length of the piles is too short, the chalk mark property and the appearance of the product are deteriorated, while when the length is too long, the superfine fibrillated piles in the product are apt to cause pilling.

Adhesives to be used in the present invention must strongly adhere the above described composite fiber piles to the substrate fabric and be stable against a swelling agent and hot water and the like. Such adhesives are thermosetting adhesives which are cured (cross-linking, net-work formation) by heating and become insoluble against hot water and an organic solvent.

As thermosetting adhesives, mention may be made of aminoplast resins, such as melamine-formaldehyde initial condensate, urea-formaldehyde initial condensate and the like; copolymers consisting of at least one of vinyl monomers having a functional group selected from the group consisting of methylolated acrylic amide, methylenebisacrylic amide, glycidyl acrylate and glycidyl methacrylate, at least one of vinyl monomers having ester group selected from the group consisting of alkyl acrylates, alkyl methacrylates, 2-hydroxyalkyl acrylate and 2-hydroxyalkyl methacrylates, and a vinyl monomer having carboxyl group selected from the group consisting of acrylic acid and methacrylic acid; polyamides having methylol group, polyurethanes having free isocyanate; acrylonitrile-butadiene copolymers having free carboxyl group. These adhesives may be used in combination of at least two substances and the most preferable combination is an aminoplast resin and a copolymer consisting of a vinyl monomer having the above described functional group and a vinyl monomer having ester group and a vinyl monomer having carboxyl group.

The adhesive may be used in a solution or emulsion form.

An amount (calculated as solid content) of the adhesive used in the present invention is 80–190 g per 1 $m^2$ of the substrate fabric, preferably 90–160 g.

When the amount of the adhesive is too small, it is difficult to secure the piles on the substrate fabric stably, and when said amount is excessive, the feeling of the product is poor.

When the surface of the substrate fabric to be applied with the adhesive is uneven, if an under coating is effected by using the same adhesive as used in the present invention to make the surface plane and then the adhesive coated surface is dried, after which the adhesive is applied thereon, the adhesion of the piles and the appearance of the product are preferably improved. In this case, an amount of the adhesive applied is 30–50 g/$m^2$ for the under coating and is 58–105 g/$m^2$ for the secondary coating.

The adhesive is applied with known processes, such as knife coating, roller coating and the like.

The flocking is carried out by applying an adhesive on a substrate fabric in a uniform thin film and flocking the piles of the separable composite filaments by using a known flocking machine, electrostatic flocking machine and the like, after which when heat drying is conducted to cure the adhesive, the flocked cloth aimed in the present invention can be obtained.

The density of the piles of the separable composite fibers is 15,000–150,000 piles, preferably 27,000–120,000 piles per 1 $cm^2$ of the substrate fabric. When the pile density is too low, the density of the superfine fibrillated piles of the product is too low and the chalk mark property and the appearance are poor, while when the pile density is too high, the density of the superfine fibrillated piles of the product is too high and the chalk mark property of the product is apt to become poor.

After flocking, the applied adhesive is preferably dried by heating or a heat treatment (105°–130° C. for 1–15 minutes) is effected after drying to cure the adhesive.

The piles of the thus obtained flocked clock are substantially uniformly distributed on the substrate fabric and stably adhered with the adhesive, but the piles are not fibrillated, so that the touch is poor and the pile state and the appearance are same as those of a usual flocked cloth.

Then the piled adhered on the substrate fabric is applied with a swelling agent and then subjected to brushing to separate (fibrillate) the piles into each segment constituting the above described cross-section.

The applying of a swelling agent on the piles adhered on the substrate fabric is preferred to be carried out by using an apparatus, such as gravure roll so as to apply the swelling agent quantitatively and only on the pile portion.

An amount of the swelling agent applied on the composite fiber piles varies depending upon the kind of the swelling agent but is usually 50–200 g, preferably 70–150 g per 1 $m^2$ of flocked pile area. When the amount of the swelling agent applied is too small, even if the brushing is thereafter carried out, the fibrillating of the composite fiber piles is hardly caused. When said amount is excessive, the superfluous swelling agent flows down and the adhesive layer is swelled or the abrasion resistance and durability of the product is liable to be deteriorated.

The swelling agents to be used in the present invention are ones which accelerate promotion of fibrillation of the composite fiber piles but do not swell the adhesive layer. As the swelling agents, a water solution or an aqueous emulsion containing 1.5–50% by weight of at least one selected from the group consisting of tripropylene glycol, cyclohexanol, methylcyclohexanol, cyclohexanone, tetrahydrofuran, methyl ethyl ketone, benzyl alcohol and phenethyl alcohol.

Such as aqueous emulsion of the swelling agent usually contains 0.3–3% by weight of anionic or nonionic surfactant as an emulsifier and a penetrating agent. However, if a surfactant is similarly contained in an aqueous solution of the swelling agent, the surface tension lowers similarly to the case of the aqueous emulsion and the deposition and penetration of the swelling agent into the above described piles become uniform and easy.

After the separable composite fiber piles are applied with the swelling agent, the piles are brushed with a usual brushing apparatus (for example, a brushing roll, a roll provided with soft needle cloth). In this case, the composite fiber piles are separated (fibrillated) into each segment by the swelling function of the swelling agent and a strong friction force owing to brushing into superfine fibrillated piles. As the brushing condition, the surface speed of the brushing roll is 5–30 m/min, preferably 10–25 m/min and the running speed of the flocked substrate fabric is 0.5–5 m/min preferably 1.5–4 m/min. This fibrillation occurs along the whole length of the composite fiber piles from the root portion to the top surface and the portion from said root portion to the root end of the piles contacting to the substrate fabric surface does not cause the fibrillation. Therefore, after the fibrillation, the separable composite fibers as such remains beneath from the root portion without causing the fibrillation and above the root portion, the segments in the cross-section of the separable composite filament form superfine fibrillated piles. For example, in the flocked cloth wherein the composite fiber piles having the cross-section of FIG. 6 are flocked on the substrate fabric, *-shaped (segment (A)) superfine fibrils and wedge-shaped (segment (B)) superfine fibrils form the fibrillated pile portion on the substrate fabric. The superfine fibrils (polyamide fibrils and polyester fibrils) formed by brushing are substantially perpendicular to the substrate fabric as in piles of a usual flocked cloth and extend upwardly and are neither curved nor entangled as the superfine fibrils of the product of the present invention. Since the superfine fibrils are very fine, a soft touch is obtained but even if said fibrils are touched with a finger, the chalk mark as in a suede is not formed. However, the inventor has found that when the brushed flocked cloth is subjected to wet heat treatment, the density of polyamide fibrils in the pile layer increases from the surface of the superfine fibrillated pile layer to the root portion and that each fibril curves and the fibrils entangle with one another to form a pile layer, whereby an artificial leather having chinchilla-like appearance and natural suede-like feeling can be obtained.

The wet heat treatment is carried out by a steaming treatment on a heat treatment in hot water or hot dyeing solution. The temperature of the wet heat treatment is 80°–135° C., preferably 100°–135° C. When said temperature is higher than 135° C., the strength of the fibrils constituting the flocked cloth lowers. The heat treatment is 5–60 minutes, preferably 10–20 minutes in the steaming treatment or 10–150 minutes, preferably 30–120 minutes in the heat treatment in water or dyeing solution. The heat treatment in dyeing solution can be carried out concurrently the dyeing treatment and the wet heat treatment. The heat treatment in dyeing solution means a usual process in which the dyeing is carried out under atmospheric pressure or a dyeing process under high pressure wherein the dyeing is carried out in a high pressure dyeing machine. Among the processes of heat treatment in dyeing solution, the high pressure dyeing process is the most preferable.

The wet heat treatment in water may be carried out under atmospheric pressure or high pressure. The wet heat treatment carried out in water or dyeing solution is better in the conduction of heat and the heat treatment is more uniformly carried out.

The wet heat treatment may be carried out after the swelling agent is removed by washing with water after the brushing treatment but when said heat treatment is carried out in a sealed vessel or a sealed chamber, a specific washing step using water is not needed.

When the flocked cloth applied with an appropriate amount of swelling agent is heat treated in a dyeing solution, the uniform dyeing, the dyeing affinity and the friction fastness of a dye are improved.

After the dyeing under atmospheric pressure or the dyeing under high pressure is carried out as the wet heat treatment, it is desirable to transfer the dyed product to a water-washing step to wash thoroughly said product with water. However, when the heat treatment is carried out in water alone or the steaming treatment is carried out, it is not necessary to effect the washing with water.

When the wet heat treatment is carried out as mentioned above, the bonded portions remaining in the segments of the composite fibers and between the superfine fibrils are subjected to thermal or mechanical stimulation to effect substantially completely the fibrillation (disengagement), whereby more superfine fibrils are formed and the superfine fibrils in the pile layer are curved or bent and entangled to form the state as shown in FIG. 18 and to make the thickness of the pile layer smaller (as compared with the thickness of the pile layer after brushing). In this case, the polyamide fibrils shrink about 15–30% (the polyester fibrils do not substantially shrink) and are curved or bent and entangled, so that the content of the polyamide fibrils in the pile layer increases from the pile layer surface toward the root portion of the fibrillated piles as mentioned above. As the result, the pile layer surface after the wet heat treatment is mainly constructed with polyester fibrils and the superfine fibrils are entangled with one another in the pile layer, so that the abrasion resistant fastness of the pile layer is considerably improved. Furthermore, the substantially complete fibrillation of the composite filaments, the curving, bending and entangling of the superfine fibrils and the increase of the content of the polyamide fibrils as mentioned above provide chinchilla-like elegant and noble appearance, excellent suede-like chalk mark property, and very soft feeling and the functional effect is very high. Such unique functional effect can be developed only by the particularly defined combination of the processes of the present invention.

For example, even if the flocked cloth is applied with a swelling agent and then brushed after wet heat treating, alternatively even if a dry heat treatment is carried out instead of the wet heat treatment, or even if the flocked cloth is immersed in a swelling agent and then subjected to a brushing treatment and the wet heat treatment, it is impossible to develop the above described unique functional effect. This fact will become apparent from the result of Comparative Examples described hereinafter.

The present invention will be explained in more detail.

For better understanding of the invention, reference is taken to the accompanying drawings, wherein:

FIG. 1 is a transverse cross-sectional view of a composite fiber of an islands-in-a-sea structure and FIG. 2 is a transverse cross-sectional view of a side-by-side type composite fiber having a hollow portion;

Figure 17:
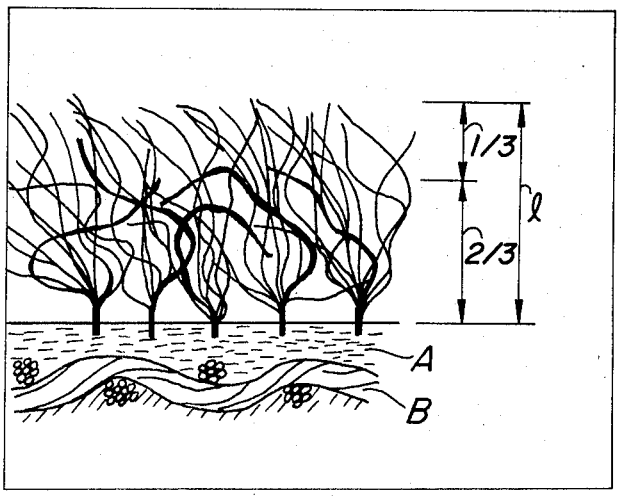
Figure 18:
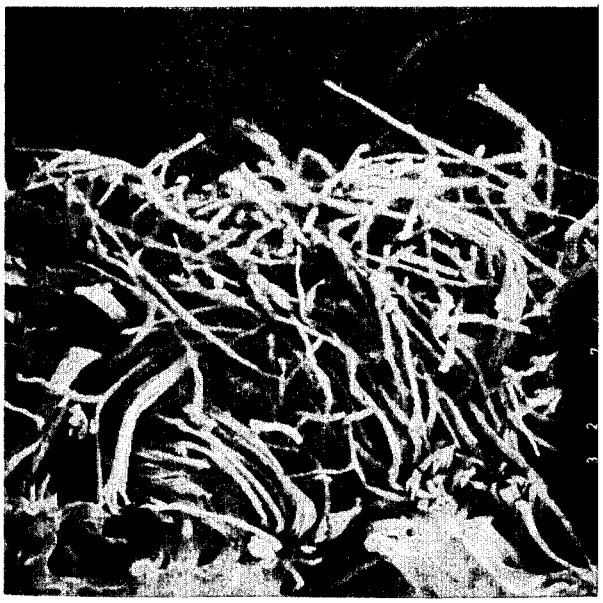
Figure 19:
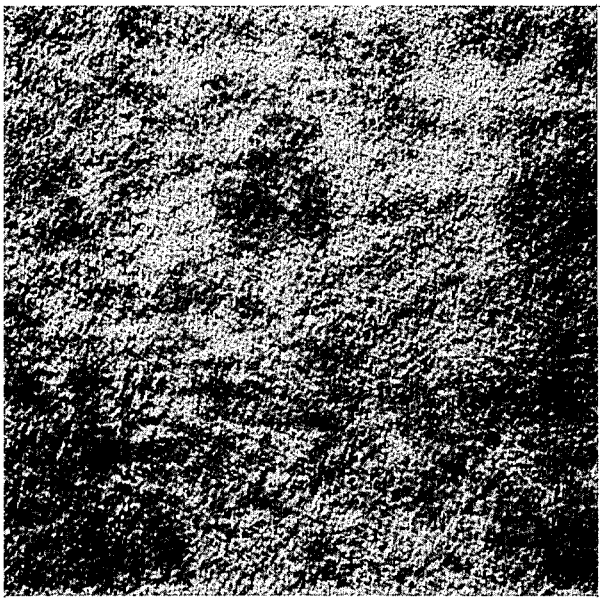

FIG. 17 is an enlarged schematic vertical view of the artificial leather according to the present invention, in which A is an adhesive layer, B is a substrate fabric, l is the thickness of the fibrillated pile layer, $\frac{1}{3}$ shows the zone of $\frac{1}{3}$ of the thickness from the pile layer surface and $\frac{2}{3}$ shows the zone of $\frac{2}{3}$ of the thickness from the substrate fabric surface applied with the adhesive;

FIG. 18 is an enlarged scanning type electron microscopic photograph of the vertical cross-section of the artificial leather of the present invention; and FIG. 19 is a photograph showing the surface of the artificial leather of the present invention.

The following examples are given for the purpose of illustration of this invention and are not intended as limitations thereof. In the examples, "%" and "parts" mean % by weight and parts by weight unless otherwise indicated.

In the examples, measuring of relative content of polyamide fibrils, that of thickness of fibrillated pile layer, that of length of superfine fibrils in the fibrillated pile layer, that of fineness of superfine fibrils in the fibrillated pile layer and that of superfine fibrillated pile density, and tests of appearance, chalk mark property, strength of flocked fibrils, abrasion resistance and touch of the product were carried out in the following manner.

1. Measurement of relative content of polyamide fibrils:

The relative content (P) of polyamide fibrils is represented by the following formula $$P(\%)=(N_v/N_o)\times 100$$

In the formula, $N_v$ is the weight ratio of the amount of polyamide fibrils to the total amount of fibrils (polyamide fibrils+polyester fibrils) in the upper layer of $\frac{1}{3}$ of the total thickness of the pile layer from the surface of the layer, and $N_o$ is the weight ratio of the amount of polyamide fibrils to the total amount of fibrils (polyamide fibrils+polyester fibrils) in the lower layer of $\frac{2}{3}$ of the total thickness of the pile layer from root portion of the fibrillated piles. The above described $N_v$ and $N_o$ are measured by the thermal differential analysis method.

2. Measurement of thickness of fibrillated pile layer:

A pressure of 50 g/cm$^2$ is applied to the surface of fibrillated pile layer of a flocked cloth sample, and the length $l_1$ from the pile surface to the back surface of substrate fabric is measured, and then the length $l_2$ from the back surface of the substrate fabric to the root portion of the pile is measured. The pile length is calculated by the following formula:

$$l=l_1-l_2$$

The lengths $l_1$ and $l_2$ are measured by a microscope.

3. Measurement of length of superfine fibrils (polyamide fibrils and polyester fibrils) in the fibrillated pile layer:

Root portion of fibrillated piles of flocked cloth sample is cut under a microscopical observation and polyamide fibrils and polyester fibrils are taken out. Then, the fibrils are arranged on a glass plate, on which mineral oil has been flowed in the form of a thin film, and curved portion of the fibrils is made into straight by means of a pin-cette, and the length of the fibrils is measured by an ocular micrometer under a microscopical observation.

4. Measurement of fineness of superfine fibrils (polyamide fibrils and polyester fibrils) in the fibrillated pile layer:

Superfine fibrils in the fibrillated pile of a flocked cloth sample are cut out, embedded in paraffin wax, fixed to a microtome, and cut into a test piece having a thickness of 5 μm. The test piece is observed by an optical micrometer of 1,050 magnifications, and enlarged cross-sectional shapes of the superfine fibrils are drawn on a section paper. Then, the drawn cross-sectional shape portions of the fibrils are cut out from section paper, and the weight thereof is measured, which is W mg. While, a square having a side length of 105 mm is cut out from the section paper, and the weight thereof is measured, which is $W_o$ mg. Cross-sectional area per one superfine fibril is calculated from the following formula $$\text{Cross-sectional area}(S)=(W/W_o)\times 10^4 \text{ (square micrometers)}$$

The fineness of the fibril is calculated from the following formula $$\text{Fineness(denier)}=9\times S\times(\text{density of the fibril})\times 10^{-3}$$

In the above formula, a density of 1.18 g/cm$^3$ was used in the case of polyamide fibril, and a density of 1.38 g/cm$^3$ was used in the case of polyester fibril.

5. Measurement of superfine fibrillated pile density.

Surface of a flocked cloth product is photographed in a magnification of 150 times by means of a scanning type electron microscope. Then, 3 portions having an area of 4.0 cm$^2$ are randomly selected on the photograph, and the number a of total superfine fibrils in each area of 4.0 cm$^2$ is measured. Superfine fibrillated pile density in the area is calculated from the following formula.

$$\text{Superfine fibrillated pile density (fibrils/cm}^2)=(a/4)\times(150)^2$$

The average value of the above measured values in above described three areas is the superfine fibrillated pile density of the product.

6. Appearance was estimated by the naked eye observation of 5 skilled testers. The estimation standard is as follows.
   - ◎ Chinchilla-like, noble and very beautiful appearance.
   - ○ Chinchilla-like and fairly beautiful appearance.
   - Δ No chinchilla-like, and somewhat coarse appearance.
   - × No chinchilla-like, and very coarse appearance.
7. Chalk mark property was measured by the naked eye observation of 5 skilled testers. The estimation standard is as follows.
   - ◎ Chalk mark appears very distinctly and beautifully.
   - ○ Chalk mark appears distinctly.
   - Δ Chalk mark appears somewhat.
   - × Chalk mark does not appear.
8. Strength of flocked fibrils was measured according to A-1 (Edge process) of method A (Rubbing test machine method) for measuring the strength of flocked fibrils described in JIS-L 1084-1977. The number of rubbing times until the flocked fibrils were peeled and the substrate fabric was exposed, was measured. The estimation standard is as follows.
   - 5th grade: at least 3,000 times
   - 4th grade: 2,000–3,000 (exclusive) times
   - 3rd grade: 1,000–2,000 (exclusive) times
   - 2nd grade: 500–1,000 (exclusive) times
   - 1st grade: less than 500 times
9. Abrasion resistance by Sheaffer test:
   (1) Abrasion resistance of fibrillated pile was estimated by a Sheaffer type abrasion tester.
   Test condition:
   Rubbing pressure: 1 lb/inch$^2$ Rubbing: Two fellow flocked cloth samples are superposed so that the pile surfaces are faced, and are rubbed with each other.

(2) Estimation method:

A flocked cloth is rubbed up to 3,000 times, and the number of bubbing times is grouped every 500 times, such as 500, 1,000, 1,500, . . . 3,000, and the rubbed portion is observed by naked eye and microscope. The abrasion resistance is estimated by the maximum number of rubbing times in a group below the group, wherein any variation is firstly observed by naked eye and microscope with respect to the following estimation standards in the rubbed portion. That is, the larger is the value (number of rubbing times) of a sample, the higher abrasion resistance the sample has.

Estimation standards for abrasion resistance are as follows:

(a) Peeling of pile.

(b) Formation of pills due to the entanglement of piles.

(c) Fusion of fellow piles.

In the present invention, it is necessary that the fibrillated pile of a product has an abrasion resistance of the number of rubbing times of at least 2,000, preferably at least 2,500, in Sheaffer test.

10. Touch was estimated by the touch by 5 skilled testers. The estimation standard is as follows:

◎ Very graceful and very soft touch.

○ Graceful and soft touch.

Δ Somewhat hard touch.

× Coarse and hard touch.

EXAMPLE 1

Figure 6:
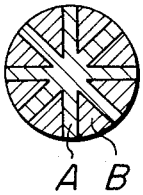
Figure 7:
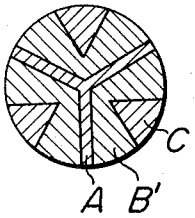

Nylon-6 (hereinafter abbreviated as 6 N) having an intrinsic viscosity of 1.13 at 30° C. in metal-cresol and polyethylene terephthalate (hereinafter abbreviated as PET) having an intrinsic viscosity of 0.68 at 30° C. in ortho-chlorophenol were melted and conjugated spun in a conjugate ratio (weight ratio) of 6 N/PET of $\frac{1}{3}$, and the extruded filaments were taken up on a bobbin at a take-up rate of 700 m/min to obtain undrawn composite filaments having substantially the same cross-sectional shape as FIG. 6. In the conjugate spinning, 6 N and PET were bonded so that 6 N was formed into a *-shaped segment and PET was formed into sector-shaped segments, by means of a spinneret having a structure similar to that of the spinneret shown in FIG. 23 of U.S. Pat. No. 4,073,988 specification.

The resulting undrawn filaments were drawn to about 4 times of their original length by means of a hot roller kept at 85° C., and the drawn filaments were contacted with a hot plate kept at 150° C. and heat set to obtain composite filaments having a fineness of 40 deniers/25 filaments (fineness of monofilament: 1.6 deniers). The resulting composite filaments were cut into piles (short fibers) having a length of 0.5 mm, and used for flocking.

While, a thermosetting adhesive consisting of 100 parts of an aqueous emulsion containing 44% of a copolymer, which consisted of 80 parts of ethyl acrylate, 2 parts of acrylic acid, 1 part of methacrylic acid, 2 parts of acrylamide, 1.5 parts of N-methylolacrylamide and 3.5 parts of 2-ethylhexyl acrylate; 5 parts of trimethylolmelamine and 0.5 part of a hardening catalyst was uniformly applied, in an amount of 250 g/m$^2$ (115 g/m$^2$ as a solid base) to the surface of a twill fabric (substrate fabric) knitted from polyethylene terephthalate-rayon mix spun yarns.

The above obtained piles of composite fiber were flocked onto the surface of the above treated twill fabric by means of an electrostatic flocking machine so that the flocked twill fabric would have a pile density of 32,000 piles/cm$^2$. Then, the flocked twill fabric was dried, and heat treated at 120° C. for 3 minutes to cure the adhesive. It was found that the amount of cured adhesive was 110 g/m$^2$. In the resulting flocked cloth, the height of the pile layer was 0.45 mm, and each pile was projected from the substrate fabric surface in a direction substantially perpendicular to the fabric surface. The flocked cloth had no chalk mark property.

Then, a swelling agent consisting of 10 parts of cyclohexanol, 1 part of a nonionic surfactant (polyoxyethylene lauryl ether) and 89 parts of water was adhered to the piled surface of the flocked cloth by means of a 30-mesh gravure roll so that the adhered amount of the swelling agent would be 100 g/m$^2$. Immediately, the pile portion (pile of composite fiber) on the flocked cloth was brushed and fibrillated by means of a brushing roll under a condition that the running velocity of the flocked cloth was 1.5 m/min and the surface velocity of the brushing roll was 20 m/min. In this brushing, the brushing width (contact width) was 5.0 cm. As the result of this brushing, the composite fibers constituting the pile portion were fairly fibrillated, and the brushed flocked cloth had a relatively soft touch, but were insufficient in the chalk mark property. In the brushed flocked cloth, the pile layer had a thickness of 0.44 mm, the polyamide fibrils had a length of 0.43 mm, the polyester fibrils had a length of 0.45 mm. Further, the relative content of polyamide fibrils in the pile portion was 96%, and all the superfine fibrils were substantially straight and were not entangled with each other. The appearance of the brushed flocked cloth was similar to that of the flocked cloth before the swelling agent treatment, and was considerably different from suede-like appearance.

Then, 10 kg of the brushed flocked cloth was immersed in a dye bath consisting of 1 kg of a disperse dye (I.G., Disperse red 145), 400 g of a dispersing agent, 80 g of acetic acid and 400 l of water, and dyed (wet heat treated) at 130° C. for 60 minutes in a high pressure dyeing machine, washed with water and dried to obtain a product of the present invention.

The above obtained product of the present invention had a chinchilla-like appearance as shown in FIG. 19, a suede-like soft feeling and an excellent chalk mark property. The product further had an abrasion resistance of 3,000 rubbing times in Sheaffer test and a 5th grade strength in the flocked fibrils, and was superior to natural suede in the abrasion durability.

In the product, the superfine fibrillated pile density was 400,000 fibrils/cm$^2$, and the fibrillated pile layer had a thickness of 0.35 mm, the polyamide fibrils had a length of 0.38 mm, the polyester fibrils had a length of 0.45 mm, the polyamide fibrils had a fineness of 0.5 denier and the polyester fibrils had a fineness of 0.17 denier. The relative content of polyamide fibrils was 70% and the content of polyamide fibrils in the pile layer increased from the surface of the pile layer to the surface of substrate fabric. Further, the superfine fibrils in the pile layer were irregularly curved or bent as shown in the photograph of FIG. 18 and were substantially entangled with each other.

EXAMPLE 2

The same procedure as described in Example 1 was carried out, except that the length of piles for flocking was varied as shown in the flowing Table 1. The obtained results are shown in Table 1.

Table 1

| Sample No. | Length of pile used for flocking (mm) | Superfine fibrillated pile density (fibrils/cm$^2$) | Relative content of polyamide fibrils (%) | Chalk mark property | Strength of flocked fibrils (grade) | Abrasion resistance by Sheaffer test (number of rubbing times) | Appearance | Touch | Thickness of pile layer (mm) | Length of PAF* (mm) | Length of PEF** (mm) |
|---|---|---|---|---|---|---|---|---|---|---|---|
| 1 | 0.2 | 300,000 | 90 | Δ | 4th | 2,000 | Δ | Δ | 0.13 | 0.14 | 0.17 |
| 2 | 0.3 | 320,000 | 80 | ○ | 5th | 2,000 | ○ | ○ | 0.22 | 0.21 | 0.26 |
| 3 | 0.5 | 400,000 | 72 | ◎ | 5th | 3,000 | ◎ | ◎ | 0.35 | 0.36 | 0.45 |
| 4 | 0.9 | 400,000 | 70 | ◎ | 5th | 3,000 | ◎ | ◎ | 0.65 | 0.68 | 0.85 |
| 5 | 1.2 | 410,000 | 64 | ◎ | 5th | 3,000 | ◎ | ◎ | 0.87 | 0.90 | 1.13 |
| 6 | 1.5 | 420,000 | 51 | ◎ | 5th | 3,000 | ◎ | ◎ | 1.12 | 1.17 | 1.46 |
| 7 | 1.7 | 420,000 | 40 | ◎ | 5th | 2,500 | ◎ | ◎ | 1.26 | 1.30 | 1.64 |
| 8 | 2.0 | 420,000 | 30 | ○ | 5th | 2,000 | ○ | ○ | 1.49 | 1.54 | 1.93 |
| 9 | 3.0 | 400,000 | 28 | Δ | 5th | 1,000 | Δ | Δ | 1.85 | 2.33 | 2.92 |

Note:
*Abbreviation of polyamide fibrils
**Abbreviation of polyester fibrils

In sample No. 1 to No. 9, the pile layer was composed of polyamide fibrils having a fineness of 0.48–0.50 denier and polyester fibrils having a fineness of 0.16–0.17 denier. In sample No. 1, superfine fibrils in the pile layer were not substantially curved, nor entangled with each other. However, in sample No. 2–No. 8, superfine fibrils in the pile layer were curved or bent and entangled with each other. In sample No. 9, the superfine fibrils were pilld during the measurement of the abrasion resistance by Sheaffer test.

COMPARATIVE EXAMPLE 1

(Dry heat treatment is carried out in place of the wet heat treatment of the present invention).

The same procedure as described in Example 1 was carried out, except that a dry heat treatment was carried out at 130° C. for 10 minutes in place of the high pressure dyeing (wet heat treatment) of Example 1. The product had a thickness of fibrillated pile layer of 0.43 mm, a length of polyamide fibrils of 0.42 mm, a length of polyester fibrils of 0.45 mm and a superfine fibrillated pile density of 410,000 fibrils/cm$^2$. In the product, the relative content of polyamide fibrils was 94%, and superfine fibrils were substantially straight and were not curved nor entangled with each other. Further, the product had a somewhat hard feeling and an insufficient chalk mark property (mark Δ). The product had a 4th grade strength in the flocked fibrils and an abrasion resistance of 1,500 rubbing times in Sheaffer test. Moreover, the product had a somewhat suede-like appearance, but the appearance was considerably different from the chinchilla-like appearance of the product of Example 1.

COMPARATIVE EXAMPLE 2

(Flocking-wet heat treatment-applying a swelling agent-brushing.)

The same procedure as described in Example 1 was carried out, except that the piles were flocked to the twill fabric, and the flocked fabric was directly subjected to the high pressure dyeing (wet heat treatment) and then the the swelling agent was applied thereon and the brushing was carried out. As the result, fibrillation did not occur at all, and the resulting product had a hard feeling, and had no chalk mark property. The appearance of the product was substantially the same as that of the above flocked twill fabric. Further, the product had a thickness of pile of 0.43 mm and a pile density of 32,000 fibrils/cm$^2$. The piles were substantially straight, and were neither curved nor entangled.

As described above, when the order of the steps of the present invention is changed into any order other than that defined in the present invention, a suede-like artificial leather having a chinchilla-like appearance cannot be obtained.

EXAMPLE 3

The same procedure as described in Example 1 was carried out, except that the amount of the swelling agent adhered to the flocked cloth was varied as shown in the following Table 2. The obtained result is shown in Table 2.

Table 2

| Sample No. | Adhered amount of swelling agent (g/m$^2$) | Chalk mark property | Strength of flocked fibrils (grade) | Appearance | Touch | Abrasion resistance by Sheaffer test (number of rubbing times) | Relative content of polyamide fibrils (%) | Superfine fibrillated pile density (fibrils/cm$^2$) |
|---|---|---|---|---|---|---|---|---|
| 1 | 40 | Δ | 5th | Δ | Δ | 3,000 | 95 | 62,000 |
| 2 | 50 | ○ | 5th | ○ | ○ | 3,000 | 79 | 330,000 |
| 3 | 70 | ◎ | 5th | ◎ | ◎ | 3,000 | 73 | 400,000 |
| 4 | 100 | ◎ | 5th | ◎ | ◎ | 3,000 | 70 | 420,000 |
| 5 | 150 | ◎ | 5th | ◎ | ◎ | 3,000 | 68 | 450,000 |
| 6 | 200 | ◎ | 4th | ◎ | ◎ | 3,000 | 60 | 440,000 |
| 7 | 230 | ◎ | 2nd | ○ | ◎ | 2,500 | 59 | 460,000 |
| 8 | 300 | ○ | 1st | ○ | ○ | 1,000 | 74 | 320,000 |

It can be seen from Table 2 that the amount of swelling agent to be adhered to the flocked cloth must be 50–200 g/m$^2$, and is preferably 70–150 g/m$^2$. When the amount is less than 50 g/m$^2$, the resulting product is poor in the chalk mark property, appearance and touch, while when the amount of exceeds 200 g/m$^2$, the strength of flocked fibrils is atp to be poor. Further, in the above described sample No. 2–No. 8, the superfine fibrils were substantially curved or bent, and entangled with each other in the pile layer. The fibrillated pile layer had a thickness of 0.34–0.36 mm, the polyamide fibrils had a length of 0.37–0.38 mm and the polyester fibrils had a length of 0.44–0.45 mm.

EXAMPLE 4

The same procedure as described in Example 1 was carried out, except that each of the following swelling agents was used in place of the swelling agent used in Example 1.

Swelling agent No. 1:
Aqueous emulsion consisting of 15 parts of tripropylene glycol, 2 parts of polyoxyethylene lauryl ether and 83 parts of water.

Swelling agent No. 2:
Aqueous emulsion consisting of 9 parts of benzyl alcohol, 2 parts of polyoxyethylene lauryl ether and 89 parts of water.

Swelling agent No. 3:
Aqueous emulsion consisting of 7 parts of methylcyclohexanol, 2 parts of polyoxyethylene lauryl ether and 91 parts of water.

Swelling agent No. 4:
Aqueous emulsion consisting of 12 parts of methylcyclohexanone, 2 parts of polyoxyethylene lauryl ether and 86 parts of water.

Swelling agent No. 5:
Aqueous emulsion consisting of 30 parts of tetrahydrofuran, 2 parts of polyoxyethylene lauryl ether and 68 parts of water.

The obtained results are shown in the following Table 3.

Table 3

| Swelling agent No. | Relative content of polyamide fibrils (%) | Superfine fibrillated pile density (fibrils/cm$^2$) | Chalk mark property | Strength of flocked fibrils (grade) | Abrasion resistance by Sheaffer test (number of rubbing times) | Appearance | Touch |
|---|---|---|---|---|---|---|---|
| 1 | 72 | 360,000 | O | 5th | 3,000 | O | O |
| 2 | 60 | 380,000 | O | 5th | 3,000 | O | O |
| 3 | 63 | 360,000 | O | 5th | 3,000 | O | O |
| 4 | 65 | 380,000 | O | 5th | 3,000 | O | O |
| 5 | 68 | 380,000 | O | 5th | 3,000 | O | O |

All the resulting products were suede-like artificial leathers having an excellent chinchilla-like appearance similarly to the product of Example 1. In the product, the fibrillated pile layer had a thickness of 0.34–0.35 mm, the polyamide fibrils had a length of 0.37–0.38 mm and the polyester fibrils had a length of 0.44–0.45 mm. The superfine fibrils in the fibrillated pile layer were substantially curved or bent and were entangled with each other.

EXAMPLE 5

The same procedure as described in Example 1 was carried out, except that piles having a length of 1.2 mm were used, and the dyeing temperature (wet heat treatment temperature) was varied as shown in the following Table 4. The obtained results are shown in Table 4.

Table 4

| Sample No. | Dyeing temperature (°C.) | Relative content of polyamide fibrils (%) | Superfine fibrillated pile density (fibrils/cm$^2$) | Chalk mark property | Strength of flocked fibrils (grade) | Abrasion resistance by Sheaffer test (number) of rubbing times | Appearance | Touch |
|---|---|---|---|---|---|---|---|---|
| 1 | 60 | 95 | 180,000 | Δ-x | 5th | 3,000 | Δ-x | Δ-x |
| 2 | 80 | 80 | 260,000 | O | 5th | 3,000 | O | O |
| 3 | 100 | 73 | 380,000 | O | 5th | 3,000 | O | O |
| 4 | 105 | 70 | 390,000 | O | 5th | 3,000 | O | O |
| 5 | 110 | 68 | 380,000 | O | 5th | 3,000 | O | O |
| 6 | 120 | 64 | 410,000 | O | 5th | 3,000 | O | O |
| 7 | 130 | 63 | 430,000 | O | 5th | 3,000 | O | O |
| 8 | 135 | 61 | 430,000 | O | 4th | 2,000 | O | O |
| 9 | 140 | 60 | 430,000 | O | 2nd | 1,000 | O | O |

It can be seen from Table 4 that the wet heat treatment temperature (dyeing temperature) must be 80°–135° C., and is preferably 100°–130° C. When the temperature is lower than 80° C., the resulting product is poor in the chalk mark property and appearance, while when the temperature is higher than 135° C., the product is poor in the touch and in the strength of flocked fibrils. In the above obtained products (sample No. 1–No. 8) of the present invention, the fibrillated pile layer had a thickness of 0.86–0.88 mm, the polyamide fibrils had a length of 0.90–0.93 mm and the polyester fibrils had a length of 1.12–1.14 mm. The superfine fibrils in the fibrillated pile layer were substantially curved or bent and were entangled with each other.

EXAMPLE 6

A pigment (channel type carbon black) was uniformly dispersed in each of the same 6 N and PET as used in Example 1 in an amount of 1.5% based on the amount of 6 N or PET at the melting step, and the melted 6 N and PET were conjugate spun, the extruded filaments were drawn and the drawn filaments were heat set in the same manners as described in Example 1 to obtain grey-colored composite filaments of 40 deniers/25 filaments (fineness of monofilament: 1.6 deniers). The composite filaments were cut to produce piles for flocking having a length of 1.2 mm. Then, the resulting piles were flocked to the same twill fabric as used in Example 1 in the same manner as described in Example 1. In the flocked cloth, the height of the pile was 1.15 mm, and piles were projected from the substrate fabric surface in a direction substantially perpendicular to the direction of the fabric surface. The flocked cloth had no chalk mark property.

The resulting flocked cloth was subjected to the same application of swelling agent and brushing as described in Example 1. As the result of the brushing, the composite fiber in the pile portion was fairly fibrillated, and the brushed flocked cloth had a somewhat soft touch, but was insufficient in the chalk mark property. In the brushed flocked cloth, the pile layer had a thickness of 1.14 mm, the polyamide fibrils had a length of 1.10 mm and the polyester fibrils had a length of 1.13 mm. Further, the relative content of polyamide fibrils was 95%, and the superfine fibrils were substantially straight and were not entangled with each other. The appearance of the brushed flocked cloth was similar to that of the flocked cloth before the swelling agent treatment, and was considerably different from suede-like appearance.

Then, 10 kg of the brushed flocked cloth was subjected to a wet heat treatment without the use of dye in 400 l of water at various temperatures shown in the following Table 5 for 60 minutes in a high pressure dyeing machine. The obtained results are shown in Table 5.

Table 5

| Sample No. | Wet heat treatment temperature (°C.) | Relative content of polyamide fibrils (%) | Superfine fibrillated pile density (fibrils/cm$^2$) | Chalk mark property | Strength of flocked fibrils (grade) | Abrasion resistance by Sheaffer test (number of rubbing times) | Appearance | Touch |
|---|---|---|---|---|---|---|---|---|
| 1 | 70 | 92 | 200,000 | Δ-x | 5th | 3,000 | Δ | Δ |
| 2 | 80 | 80 | 260,000 | O | 5th | 3,000 | O | O |
| 3 | 100 | 72 | 360,000 | O | 5th | 3,000 | O | O |
| 4 | 110 | 70 | 380,000 | O | 5th | 3,000 | O | O |
| 5 | 120 | 69 | 390,000 | O | 5th | 3,000 | O | O |
| 6 | 130 | 65 | 400,000 | O | 5th | 3,000 | O | O |
| 7 | 135 | 62 | 410,000 | O | 4th | 2,000 | O | O |
| 8 | 140 | 55 | 420,000 | O | 2nd | 1,000 | O | Δ |

It can be seen from Table 5 that the wet heat treatment temperature should be 80°–135° C. and is preferably 100°–130° C.

EXAMPLE 7

The same procedure as described in Example 1 was carried out, except that steaming was effected at 110° C. for 18 minutes, at 120° C. for 12 minutes or at 130° C. for 6 minutes in place of the high pressure dyeing (wet heat treatment). All the resulting products were excellent artificial leathers, which developed a very distinct and beautiful chalk mark, and had a chinchilla-like fairly beautiful apparance and a graceful soft touch, and whose flocked fibrils had a high strength (5th grade strength). Each of the products had an abrasion resistance of the number of rubbing times of 3,000 in Sheaffer test and a superfine fibrillated pile density of 395,000 fibrils/cm$^2$. In the products, the thicknesses of the fibrillated pile layer were 0.36 mm, 0.37 mm and 0.36 mm respectively, the lengths of polyamide fibrils were 0.38 mm, 0.39 mm and 0.38 mm respectively, the lengths of polyester fibrils were all 0.45 mm, and the relative contents of polyamide fibrils were 74%, 74% and 73% respectively. Further, in the pile layer, the superfine fibrils were curved or bent, and entangled with each other.

COMPARATIVE EXAMPLE 3

The same procedure as described in Example 1 was carried out, except that the swelling agent was not applied to the flocked cloth but the flocked cloth was immersed for 20 minutes in the swelling agent, whose amount was 30 times of the weight of the flocked cloth. The resulting product developed distinct chalk mark, but had a 1st grade strength of flocked fibrils and an abrasion resistance of the number of rubbing times of 1,000 in Sheaffer test, and was very poor in the durability in the flocked fibrils.

COMPARATIVE EXAMPLE 4

The same procedure as described in Example 1 was carried out, except that, after the application of the swelling agent, the high pressure dyeing (wet heat treatment) was directly carried out without carrying out the brushing. The resulting product had not chalk mark property (mark ×), had a coarse appearance (mark ×) and a coarse and hard touch (mark ×). The product had a thickness of pile layer of 0.45 mm and a relative content of polyamide fibrils of 99.5%. Further, the pile of the composite filament was not substantially fibrillated.

COMPARATIVE EXAMPLE 5

The sample procedure as described in Example 1 was carried out, except that islands-in-a-sea type composite fiber having a length of 0.9 mm and a fineness of monofilament of 3.5 deniers, which was disclosed in Example 4 of Japanese Patent Laid-open Application No. 14,462/72 and consisted of 40 parts of polystyrene (island constituent) and 60 parts of nylon-66 (sea constituent), was used as a pile for flocking. The resulting product had no chalk mark property (mark ×), a coarse appearance (mark ×) and a coarse and hard touch (mark ×), and further had a pile density of 32,000 fibrils/cm$^2$.

COMPARATIVE EXAMPLE 6

The same procedure as described in Example 1 was carried out, except that islands-in-a-sea type composite fiber having a length of 0.5 mm and a fineness of monofilament of 4.5 deniers, which was disclosed in Example 8 of British Patent No. 1,302,268 and consisted of 50 parts by volume of polystyrene (sea constituent) and 50 parts by volume of polyethylene terephthalate (island constituent) was used as a pile for flocking. The resulting product had no chalk mark property and had a very coarse and hard touch, and further had a pile density of 32,000 fibrils/cm$^2$.

COMPARATIVE EXAMPLE 7

The same procedure as described in Example 1 was carried out, except that toluene alone or an aqueous emulsion having a toluene concentration of 10% was used as a swelling agent in place of the swelling agent used in Example 1, and the pile of the islands-in-a-sea type composite fiber used in Comparative Example 6 was used in place of the pile of the separable type composite fiber used in Example 1. As the result, the polystyrene segment (sea constituent) was completely dissolve out, and the resulting product had piles consisting only of superfine fibrils having a fineness of 0.05 denier formed of polyamide segment (island constituent) in a pile density of 800,000 fibrils/cm$^2$. The product was excellent in the chalk mark property (mark ◎), but had a 1st grade strength in the flocked fibrils and an abrasion resistance of the number of rubbing times of 1,000 by Sheaffer test. In the product, the superfine fibrils were not curved nor entangled, and chinchilla-like appearance was not observed.

EXAMPLE 8

The same procedure as described in Example 1 was carried out, except that composite fiber having a length of 0.5 mm and a fineness shown in the following Table 6, which consisted of polyester and polyamide in a conjugate ratio of polyester/polyamide of 5/1 and had the same cross-sectional shape as that of the composite filament of Example 1, was used as a pile for flocking. The obtained results are shown in Table 6.

Table 6

| Sample No. | Fineness of pile for flocking (denier) | Thickness of fibrillated pile layer (mm) | Length of PAF (mm) | Length of PEF (mm) | Fineness of PAF (denier) | Fineness of PEF (denier) | Relative content of PAF (%) | Chalk mark property | Strength of flocked fibrils (grade) | Abrasion resistance by Sheaffer test(number of rubbing times) | Appearance | Touch |
|---|---|---|---|---|---|---|---|---|---|---|---|---|
| 1 | 1.0 | 0.34 | 0.39 | 0.45 | 0.2 | 0.10 | 65 | O | 4th | 1,000 | O | O |
| 2 | 1.2 | 0.34 | 0.39 | 0.45 | 0.24 | 0.12 | 68 | O | 5th | 3,000 | O | O |
| 3 | 1.6 | 0.35 | 0.38 | 0.45 | 0.32 | 0.16 | 70 | O | 5th | 3,000 | O | O |
| 4 | 2.0 | 0.36 | 0.38 | 0.45 | 0.40 | 0.20 | 70 | O | 5th | 3,000 | O | O |
| 5 | 2.5 | 0.37 | 0.38 | 0.45 | 0.50 | 0.25 | 72 | O | 5th | 3,000 | O | O |
| 6 | 3.0 | 0.40 | 0.38 | 0.45 | 0.60 | 0.30 | 80 | O | 5th | 3,000 | O | O |
| 7 | 3.5 | 0.41 | 0.39 | 0.45 | 0.70 | 0.35 | 86 | X | 5th | 3,000 | X | X |

In the products of sample No. 1–No. 6, the superfine fibrils were curved or bent and entangled with each other. However, in the product of sample No. 7, the superfine fibrils were neither curved nor entangled with each other. That is, the fineness of monofilament of pile (composite fiber) for flocking must be 1.0–3.0 deniers, and is preferably 1.2–2.5 deniers.

EXAMPLE 9

Figure 8:
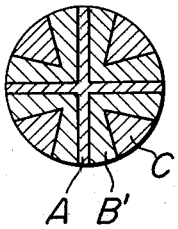
Figure 9:
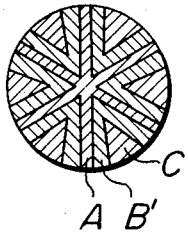
Figure 10:
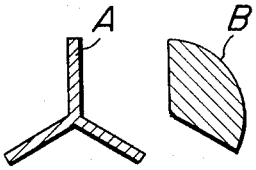
FIGS. 10, 11, 12, 13, 14, 15 and 16 are transverse cross-sectional views of segments (fibrils) formed by fibrillating the composite fibers according to the present invention.
Figure 11:
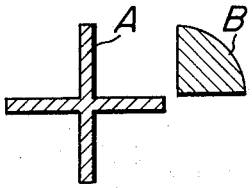
Figure 12:
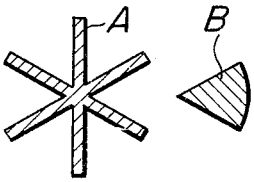
Figure 13:
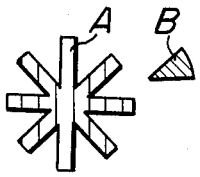
Figure 14:
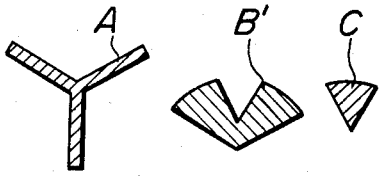
Figure 15:
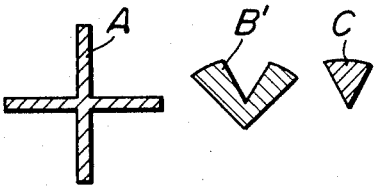
Figure 16:
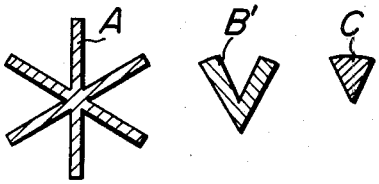

Separable type composite filaments, which consisted of nylon-66 and PET in a conjugate ratio (weight ratio) of nylon-66/PET of ½ and had a cross-sectional shape shown in FIG. 8 in the accompanying drawings, whose monofilaments had a finenesses of 1.5 d, 2.5 d or 3.0 d, were produced according to Example 1 of U.S. Pat. No. 4,073,988. In the composite filaments, the segments (A) and (C) in FIG. 8 were formed of nylon-66, and the segment (B') was formed of PET. Each of the composite filaments was cut into piles having a length of 0.5 mm. The pile was used for flocking in place of the pile for flocking used in Example 1, and the same procedure as described in Example 1 was carried out. As the result, the relative contents of polyamide fibrils were 67%, 70% and 80% respectively; the superfine fibrillated pile densities were 360,000 fibrils/cm$^2$, 420,000 fibrils/cm$^2$ and 440,000 fibrils/cm$^2$ respectively; the thicknesses of fibrillated pile layer were 0.35 mm, 0.36 mm and 0.36 mm respectively; the lengths of polyamide fibrils were 0.39 mm, 0.40 mm and 0.41 mm respectively; and the lengths of polyester fibrils were 0.45 mm, 0.45 mm and 0.46 mm respectively. In all the products, the superfine fibrils were curved and entangled with each other in the fibrillated pile layer. When composite filaments, whose monofilament had a fineness of 1.5 d or 2.5 d, were used, the products were very excellent (mark o) in any of appearance, chalk mark property and touch, and further had a 5th grade strength in the flocked fibrils. When composite filament, whose monofilament had a fineness of 3.0 d, was used, the product was excellent (mark o) in any of appearance, chalk mark property and touch, and further had a 5th grade strength in the flocked fibrils.

EXAMPLE 10

Figure 1:
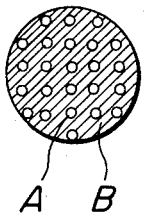
FIGS. 1 and 2 are transverse cross-sectional views of publicity known composite fibers for making fibril other than the present invention.
Figure 2:
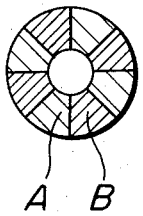
Figure 3:
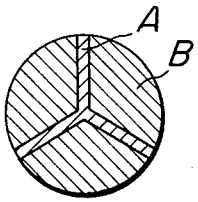
FIGS. 3, 4, 5, 6, 7, 8 and 9 are transverse cross-sectional views of the separable composite fibers to be used in the present invention.
Figure 4:
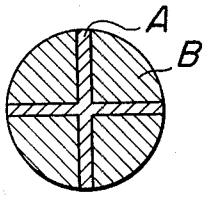
Figure 5:
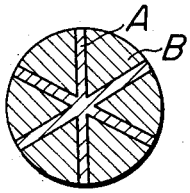

Composite filaments of 35 deniers/25 filaments (fineness of monofilament: 1.4 deniers), which had a cross-sectional shape shown in FIG. 4, were produced in the same manner as described in Example 1 of U.S. Pat. No. 4,073,988, except that the conjugate ratio of nylon 6 to polyethylene terephthalate was 1:2 (weight ratio). In the resulting composite filaments, the radially extending segment (A) consisted of the polyamide and the sector segments (B) consisted of the polyester. The composite filaments were cut into piles (short fibers) having a length of 0.9 mm and used for flocking. The piles were flocked onto a twill fabric (substrate fabric) knitted from viscose rayon in the same manner as described in Example 1, except that the pile density of flocked composite fibers was varied as shown in the following Table 7. The flocked cloth was subject to the same treatments in the adhesion of swelling agent, brushing, high pressure dyeing (wet heat treatment) and the like as described in Example 1 to obtain a product of the present invention. The obtained results are shown in Table 7.

Table 7

| Sample No. | Pile density of flocked composite fibers (fibers/cm²) | Pile density of superfine fibrils (fibril/cm²) | Thickness of superfine fibrillated pile layer (mm) | Length of PAF (mm) | Length of PEF (mm) | Fineness of PAF (denier) | Fineness of PEF (denier) | Relative content of PAF (%) | Chalk mark property | Abrasion resistance by Sheaffer test (number of rubbing times) | Appearance | Touch |
|---|---|---|---|---|---|---|---|---|---|---|---|---|
| 1 | 50,000 | 250,000 | 0.65 | 0.69 | 0.85 | 0.47 | 0.23 | 65 | O | 3,000 | O | O |
| 2 | 60,000 | 300,000 | 0.67 | 0.68 | 0.85 | 0.46 | 0.23 | 63 | O | 3,000 | O | O |
| 3 | 80,000 | 400,000 | 0.68 | 0.68 | 0.85 | 0.47 | 0.23 | 60 | O | 3,000 | O | O |
| 4 | 100,000 | 500,000 | 0.69 | 0.67 | 0.85 | 0.47 | 0.23 | 62 | O | 3,000 | O | O |
| 5 | 120,000 | 600,000 | 0.71 | 0.68 | 0.85 | 0.48 | 0.23 | 60 | O | 3,000 | O | O |

In the above obtained products of sample No. 1–No. 5, all the superfine fibrils were curved or bent in the pile layer and entangled with each other.

What is claimed is:

1. An artificial leather having a suede-like texture and chinchilla-like appearance consisting of a substrate fabric and curved and entangled fibrillated piles stuck on the substrate fabric with an adhesive, said fibrillated piles consisting of polyamide and polyester having been obtained by fibrillating the piles composed of composite fibers which in transverse cross-section consist of at least three integral segments (A) of one polymer of the above described two polymers wherein said segments diverge from each other substantially radially in the outward direction and extend to the perimeter of the fiber and wedge-shaped segments (B) of another polymer which fill the spaces between the segments (A) or consist of the above described segments (A), V-shaped segments (B') of the latter polymer and wedge-shaped segments (C) of the former polymer which fill the concavities of the V-shaped segments (B'), said V-shaped segments (B') and said wedge-shaped segments (C) filling the spaces between the segments (A), wherein all of the polymers extend to the perimeter of the fiber, so that the polymers are separated from each other to form very fine curved fibrils of (A) and (B) or (A), (B') and (C), which form fibrillated pile layer in which a content ratio by weight of polyamide fibrils in said pile layer increases from the surface of the pile layer toward the substrate fabric surface and the content ratio by weight of polyamide fibrils in total fibrils in an upper layer of $\frac{1}{3}$ of the total thickness of said pile layer from the surface of said layer is not more than 80% of a content ratio by weight of polyamide fibrils in the total fibrils in a lower layer of $\frac{2}{3}$ of the total thickness of said pile layer from the root portion of the fibrillated piles.

2. An artificial leather as claimed in claim 1, wherein the content ratio by weight of polyamide fibrils in the total fibrils in the layer from the surface in $\frac{1}{3}$ of the total thickness of the pile layer is not more than 70% of the content ratio by weight of polyamide fibrils in the total fibrils in the pile layer from the substrate fabric surface in $\frac{2}{3}$ of the total thickness of the pile layer.

3. An artificial leather as claimed in claim 1, wherein a thickness of the fibrillated pile layer is 0.2–1.5 mm.

4. An artificial leather as claimed in claim 1, wherein the length of the polyamide fibrils in the pile layer is 0.23–1.6 mm.

5. An artificial leather as claimed in claim 1, wherein the length of the polyamide fibrils in the pile layer is smaller than that of the polyester fibrils.

6. An artificial leather as claimed in claim 5, wherein the length of the polyester fibrils in the pile layer is 0.28–2.0 mm.

7. An artificial leather as claimed in claim 1, wherein a fineness of the superfine fibril is 0.05–0.8 denier.

8. An artificial leather as claimed in claim 1, wherein a density of the superfine fibrils is 250,000–600,000 fibrils/cm².

9. An artificial leather as claimed in claim 1, wherein a density of the separable composite fibers is 15,000–150,000 fibers/cm².

10. An artificial leather as claimed in claim 1, wherein a fineness of the separable composite fibers is 1.0–3.0 deniers.

11. An artificial leather as claimed in claim 1, wherein a conjugate ratio by weight of the polyamide to the polyester in the separable composite fiber is 1:5–5:1.

12. An artificial leather as claimed in claim 1, wherein a weight ratio of the polyamide fibril to the polyester fibril in the pile layer is 1:5–5:1.

13. An artificial leather as claimed in claim 1, wherein the polyamide fibril in the pile layer has a cross-sectional shape of at least three integral segments diverging from each other substantially radially from center.

14. An artificial leather as claimed in claim 1, wherein the segments (A) having the cross-sectional shape of at least three integral segments diverging from each other substantially radially from center in the separable composite fiber are formed of polyamide.

15. An artificial leather as claimed in claim 1, wherein an amount of an adhesive stuck on the substrate fabric is 78–185 g/m².

16. An artificial leather as claimed in claim 1, wherein an adhesive stuck on the substrate fabric is an adhesive consisting mainly of a thermosetting resin.

17. An artificial leather as claimed in claim 1, wherein the substrate fabric is a non-woven fabric, woven fabric or a knitted goods containing at least one of cotton, viscose rayon, cellulosic acetate fiber, polyamide fiber and polyester fiber.

18. An artificial leather as claimed in claim 1, wherein the pile layer is colored.

19. A method for producing an artificial leather having chinchilla-like appearance and a natural suede-like feeling which comprising flocking piles of separable composite fibers which is transverse cross-section consist of at least three integral segments (A) of one polymer of polyamide and polyester wherein said segments diverge from each other substantially radially in the outward direction and extend to the perimeter of the fiber and wedge-shaped segments (B) of another polymer which fill the spaces between the segments (A) or consist of the above described segments (A), V-shaped segments (B') of the latter polymer and wedge-shaped segments (C) of the former polymer which fill the concavities of the V-shaped elements (B'), said V-shaped segments (B'), said V-shaped segments (B') and said wedge-shaped segments (C) filling the spaces between the segments (A), wherein all of the polymers extend to the perimeter of the fiber, on a substrate fabric applied with an adhesive, applying a swelling agent on the piles, brushing the thus treated piles to substantially separate each segment in the above described cross-section and then subjecting the brushed piles to a wet heat treatment.

20. A method as claimed in claim 19, wherein the separable composite fiber is composed of polyester and polyamide in a conjugate ratio by weight of 1:5–5:1.

21. A method as claimed in claim 19, wherein a fineness of the separable composite fiber is 1.0–3.0 deniers.

22. A method as claimed in claim 19, wherein a length of the separable composite fiber pile to be flocked on the substrate fabric is 0.3–2.0 mm.

23. A method as claimed in claim 19, wherein the substrate fabric is a non-woven fabric, woven fabric or a knitted goods containing at least one of cotton, viscose rayon, acetate fiber, polyamide fiber and polyester fiber.

24. A method as claimed in claim 19, wherein the adhesive is a thermosetting adhesive consisting mainly of a thermosetting synthetic resin.

25. A method as claimed in claim 19, wherein the adhesive contains a thermosetting synthetic resin.

26. A method as claimed in claim 19, wherein the adhesive is applied on the substrate fabric in an amount of 80–190 g/cm$^2$ calculated as a solid content.

27. A method as claimed in claim 19, wherein the flocking is carried out by an electrostatic flocking process.

28. A method as claimed in claim 19, wherein the piles are flocked on the substrate fabric in a pile density of 15,000–150,000 piles/cm$^2$.

29. A method as claimed in claim 19, wherein the swelling agent is a water solution or an aqueous emulsion containing 1.5–50% by weight of at least one of tripropylene glycol, cyclohexanol, methylcyclohexanol, cyclohexanone, tetrahydrofuran, methyl ethyl ketone, benzyl alcohol and phenethyl alcohol.

30. A method as claimed in claim 19, wherein the swelling agent is applied in an amount of 50–200 g per 1 m$^2$ of the flocked area.

31. A method as claimed in claim 19, wherein the wet heat treatment is carried out in hot water or heated dye solution.

32. A method as claimed in claim 19, wherein the wet heat treatment is carried out at a temperature of 80°–135° C. for 5–150 minutes.

33. A method as claimed in claim 19, wherein the brushing of the piles is carried out at a surface speed of a brushing roll of 5–30 m/min and a running speed of flocked substrate fabrics of 0.5–5 m/min.

* * * * *

UNITED STATES PATENT OFFICE

CERTIFICATE OF CORRECTION

Patent No. 4 241 122 Dated December 23, 1980

Inventor(s) Koin Asano

It is certified that error appears in the above-identified patent and that said Letters Patent are hereby corrected as shown below:

Column 24, line 61; change "is" to ---in---.

Column 25, line 3; change "elements" to ---segments---.

Column 25, line 4; delete ", said V-shaped segments (B')".

Signed and Sealed this

Fourteenth Day of April 1981

[SEAL]

Attest:

RENE D. TEGTMEYER

Attesting Officer

Acting Commissioner of Patents and Trademarks